United States Patent [19]

Yargici

[11] Patent Number: 4,786,111

[45] Date of Patent: Nov. 22, 1988

[54] APPARATUS AND METHOD FOR DELIVERING LIQUID COOLANT TO DRUM MOUNTED CUTTING TOOLS

[76] Inventor: Zekeriya Yargici, 1219 Oakcrest Ave., Roseville, Minn. 55113

[21] Appl. No.: 535,724

[22] Filed: Sep. 26, 1983

[51] Int. Cl.[4] ..... E21C 35/22; E01C 23/12

[52] U.S. Cl. ..... 299/10; 299/39; 299/81; 404/90

[58] Field of Search ..... 299/81, 39, 92, 10; 239/381, 382, 524; 404/111, 90, 129

[56] References Cited

U.S. PATENT DOCUMENTS

| | | | |
|---|---|---|---|
| 1,424,728 | 8/1922 | Knight et al. . | |
| 2,612,408 | 9/1952 | Kurata | 239/382 |
| 2,649,061 | 8/1953 | Hawkins et al. . | |
| 2,866,422 | 12/1958 | Colson . | |
| 2,876,718 | 3/1959 | Vaughan . | |
| 2,975,735 | 3/1961 | Purvance . | |
| 3,025,806 | 3/1962 | Peck . | |
| 3,143,090 | 8/1964 | Cecil et al. . | |
| 3,154,031 | 10/1964 | Kappelmann . | |
| 3,211,114 | 10/1965 | Ucinhaska . | |
| 3,290,097 | 12/1966 | Hlinsky | 299/81 |
| 3,602,166 | 8/1971 | Peterson . | |
| 3,746,101 | 7/1973 | Takata . | |
| 3,753,597 | 8/1973 | French | 299/81 |
| 3,975,055 | 8/1976 | Wirtgen . | |
| 4,006,936 | 2/1977 | Crabiel . | |
| 4,326,592 | 4/1982 | Stephenson . | |
| 4,356,974 | 11/1982 | Rosenberg et al. | 239/382 |

FOREIGN PATENT DOCUMENTS

| | | | |
|---|---|---|---|
| 0010534 | 4/1980 | European Pat. Off. | 299/81 |
| 6517057 | 6/1967 | Netherlands . | |

*Primary Examiner*—Jerome W. Massie
*Assistant Examiner*—David J. Bagnell
*Attorney, Agent, or Firm*—Burd, Bartz & Gutenkauf

[57] ABSTRACT

A roadway milling machine includes a hollow, cylindrically walled, shaft mounted, imperforate drum having tungsten carbide tipped steel cutting tools supported in tool holders extending generally radially outwardly from the cylindrical surface of the drum. The drum is moved over a roadway to be milled, and is rotated on its shaft to bring the cutting tools into operative contact with the roadway. Water is fed into the drum along a water access opening provided along the axis of the drum shaft; and this coolant leaves the drum through openings provided in the cylindrical drum wall, one adjacent to each cutting tool, in position where the coolant leaving the drum will impinge upon and cool its adjacent cutting tool. In order to limit the flow of water from the drum to the cutting tools and, at the same time, to prevent the necessarily small openings from clogging up, large openings can be provided through the cylindrical drum wall and well into the tool holders which extend integrally outwardly from that wall. A transverse opening through each tool holder is open to the tool holder large radial opening in the tool holder. This transverse opening is almost completely fitted with a bolt or other rod-like structure. The minimum cross-sectional area of the bolt is less than that of the transverse slot, and the bolt is free to vibrate or otherwise move under the impetus of the shock to the tool and tool holder as the tool strikes the roadway on each rotation of the drum.

31 Claims, 3 Drawing Sheets

FIG. 1
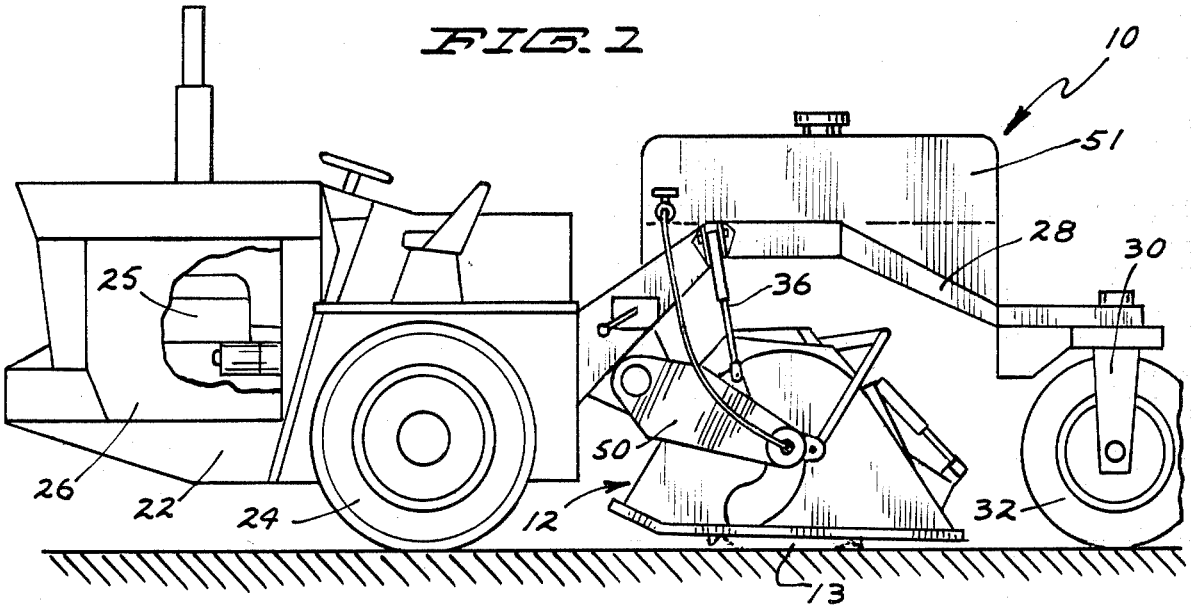
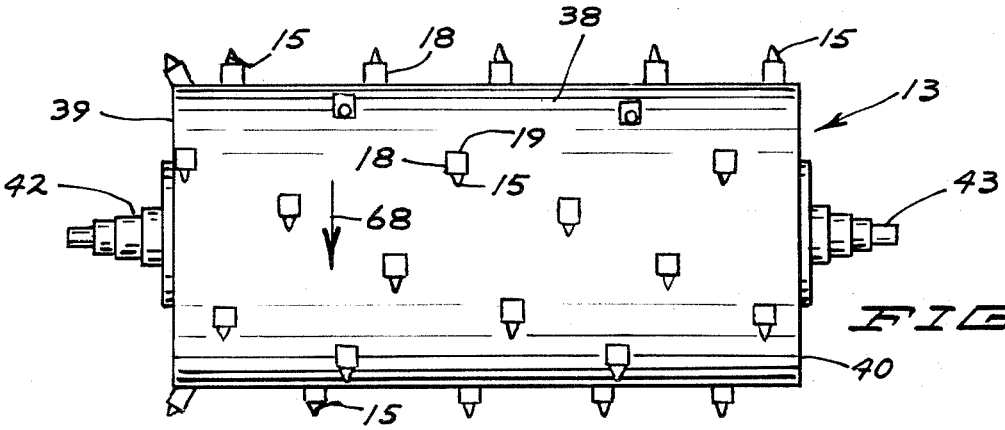
FIG. 2
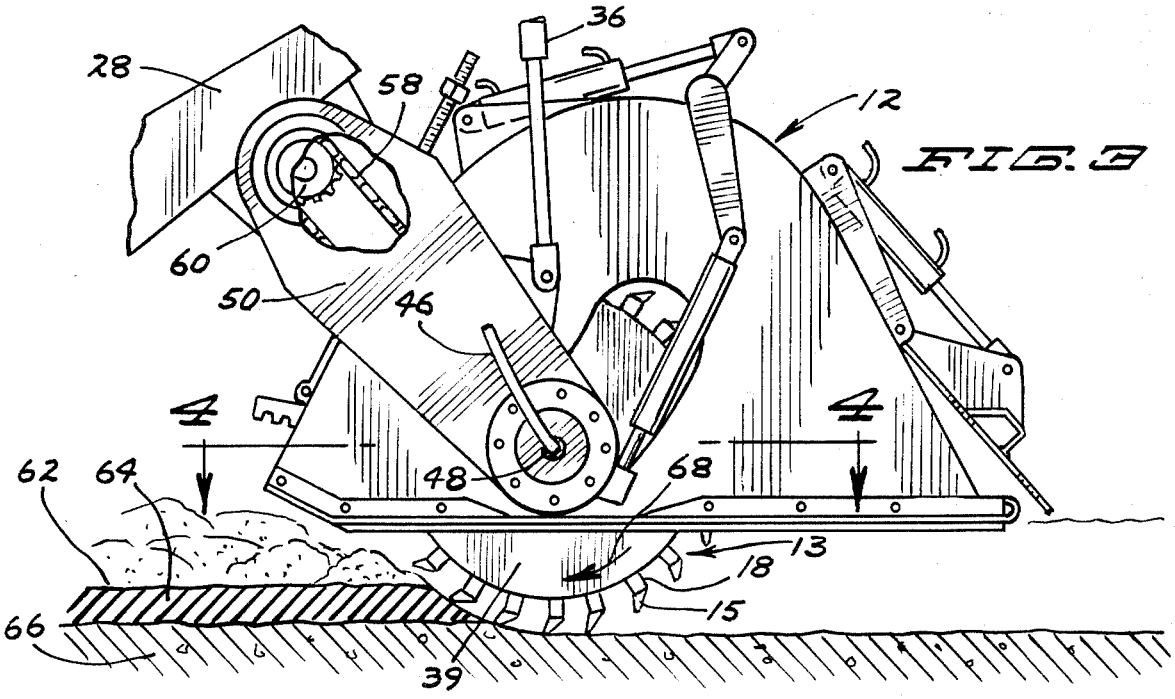
FIG. 3

APPARATUS AND METHOD FOR DELIVERING LIQUID COOLANT TO DRUM MOUNTED CUTTING TOOLS

BACKGROUND OF THE INVENTION

1. Field of the Invention.

This invention relates to material processing and more specifically to the processing of roadways; mine tunnel roofs, side walls, floors and forward faces; and other surfaces where portable machines perturb such surfaces using tool bits or other cutting tools extending outwardly from the cylindrical surfaces of rotating drums.

2. Description of the Prior Art.

It is well known to mill road surfaces using a motor driven rotatable roller equipped with hard-metal cutters. Such rollers are moved horizontally relative to the road surface while the roller is rotated to bring the hard-metal cutters in contact with the surface of the roadway to be milled. See U.S. Pat. No. 3,975,055 granted to Wirtgen on Aug. 17, 1976.

It is well established that the cooling of such hard-metal cutters to dissipate the heat generated by the cutting will greatly increase the useful working life of those cutters.

Before the present invention, this cooling was sometimes attempted by encompassing the motor driven rotatable roller in a hood such as is seen in the Bros Brochure 7WG81. Copious quantities of water coolant were then sprayed out of a spray bar and down into the top of the hood. Water coolant tankers had to run alongside of or ahead of the actual milling machines themselves to provide sufficient water for sustained operation. Something of the arrangement used can be understood from a consideration of four-page BOMAG Brochure CGE-5439-2 where a similar system is disclosed for adding water and lime slurry to the cylindrical roller and the materials being cut out of the roadway by the roller.

A major difficulty with the process of cooling the cutting tools by spraying water on the outside of the drum is that this water is necessarily picked up by the roadway materials which have been cut out by the cutting tools. To get sufficient cooling action, many, many times as much water as is theoretically needed must be sprayed onto the drum as most of the water is immediately soaked up by the roadway cuttings, and so is not available for cooling the cutting tools. This necessitates the use of such large quantities of water that water supply trucks running alongside of or ahead of the milling apparatus are a necessity.

Once the water has served its purpose, and the machine moves on, the water is left in the processed roadway materials, thus "polluting" the final mix with water which does not enhance, but can greatly retard, the further processing.

What was needed before the present invention was some way of cooling tungsten carbide tipped steel cutting tools among others as the supporting roller rotated to bring those tools in contact with the roadway surface being processed without using appreciably more water or other coolant than was actually necessary to perform the cooling.

SUMMARY OF THE INVENTION

A material processing machine is shown herein in the form of a roadway milling machine, although the invention is readily usable in connection with road reclaiming machines; with mining machines that can process the road beneath them or the side walls, roof and front face of a mine tunnel; and with any other similar machines for working natural or man laid materials having generally plane surfaces in or on the ground or earth or elsewhere. For simplicity in expression and explanation, all such machines are classified herein generally as roadway processing machines; and a particular class of machine, namely, a roadway milling machine is illustrated and described.

A roadway processing machine such as a milling machine includes a hollow, cylindrically walled, shaft mounted, imperforate drum having tool bits or other cutting tools extending outwardly from the surface of its cylindrical wall. Support means and drive means are provided for rotating the drum on its shaft axis in a first direction and for moving the drum over a work surface to be milled or otherwise processed with the cutting tools in operative contact with the work surface.

Means is provided for introducing a liquid coolant such as water or the like into the hollow drum. Coolant can be introduced into the drum by positioning the drum with a drain plug or filler cap at the top, and then pouring water into the filler opening while the drum is at rest. However, in the form of the invention as shown, water is introduced along the drum shaft, one end of the shaft being bored along its axis. Water from a water tank mounted on the exterior of the machine is allowed to flow through a conduit and an appropriate packing gland into the drum shaft water access opening.

Coolant delivery openings are provided through the cylindrical drum wall in adjacent relation to each cutting tool which extends out from the cylindrical surface of that wall, and, when the drum is rotating, water flows out through these delivery openings, flows down along tool holder associated with each cutting tool, and flows out and around the cutting tools to dissipate the heat generated in the cutting tools by the action of the tool on the work surface.

In one form of the invention, these coolant delivery openings through the cylindrical wall of the drum deliver coolant to positions immediately adjacent but spaced from the cutting tools and tool holders in the direction which the tool holders move as the drum rotates. This is a very effective structure except that because of the small volume of water which is necessary to properly cool the tools, the minimum cross-sectional diameter of these delivery openings needs to be quite small. Openings of this size tend to clog up due to corrosion, due to the occasional presence of deliterious materials in the coolant water introduced into the drum, and/or due to the materials being cut out of the roadway coming in contact with the wet drum and clogging these openings. The structure can be made to work much better by making the coolant delivery openings in the drum in this form of the invention of larger minimum cross-sectional area; but this calls for the theoretically unnecessary use of larger quantities of water.

In accordance with second and third forms of the invention, tool holders extend integrally outwardly from the cylindrical surface of the drum, and the cutting tools are mounted in those tool holders. Coolant delivery openings through the drums having several times the minimum cross-sectional area needed to support adequate coolant flow open into radially extending tool holder slots which are also much larger in minimum cross-sectional area than necessary.

Each of these radial slots in each of the tool holders is open to a transversely extending slot which opens at least to that side of the tool holder facing in the direction of the movement of the tool holder around that drum. A bolt or rod-like member extends through the transversely extending slot and has a lesser cross-sectional area between the radial slot and the face of the tool holder to which it opens than that of the transverse slot over the same distance. The difference between the cross-sectional area of the transverse slot and of the bolt or rod-like member is such as to permit the desired amount of coolant flow out of the tool holder where it will move out into cooling relationship with respect to the cutting tool. The rod-like member will be supported loosely enough in the transverse tool holder slot so that it will vibrate or otherwise move sufficiently with respect to the transverse slot in the tool holder each time the cutting tool comes in contact with the work surface as the drum rotates. This vibration or other shock causes any materials which are tending to clog the coolant passageway through the transverse slot to be dislodged to the end that the structure of the invention can be operated for long intervals without maintenance and without down time to clear up clogged coolant passageways.

Applicant has not made or had made a specific search on the subject matter of the invention. However, applicant and those in privity with him are aware of no prior art which anticipates this invention and the claims made therein, and are aware of no prior art closer than that discussed above.

BRIEF DESCRIPTION OF THE DRAWINGS

FIG. 1 is a side elevational view of a roadway milling machine adapted to carry a tool holding drum in which milling bits or cutting tools are mounted;

FIG. 2 is an elevational view of a cylindrical tool holding drum for use in the roadway milling machine of FIG. 1 with milling bits or cutting tools mounted therein and extending radially outwardly therefrom;

FIG. 3 is an enlarged fragmentary view of a portion of the roadway milling machine of FIG. 1 and including a drum encompassing hood showing the operational relationship of the tool holding drum and its cutting tools with respect to a roadway being milled;

DETAILED DESCRIPTION OF THE PREFERRED EMBODIMENTS

Figure 4:
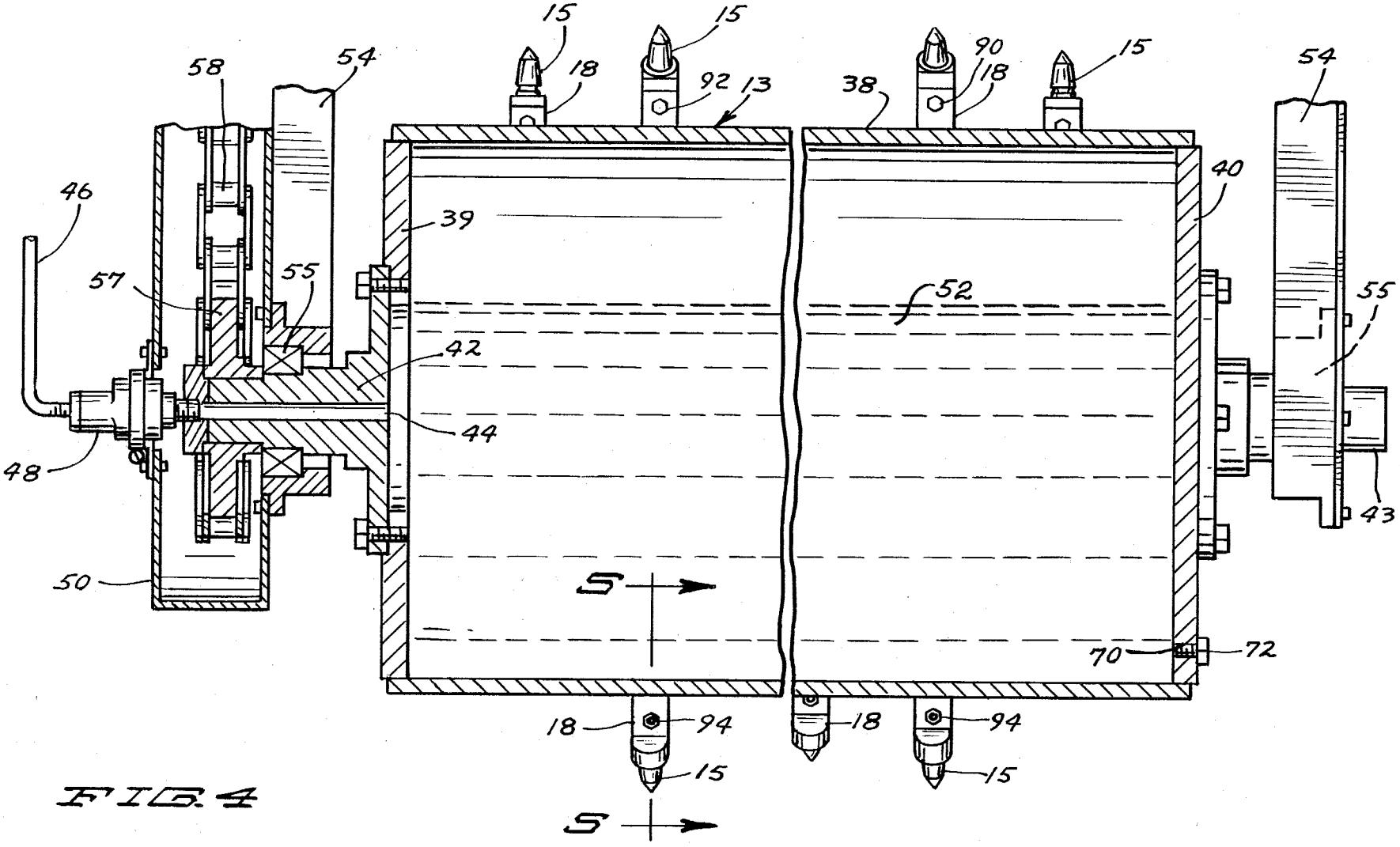
FIG. 4 is an enlarged horizontal sectional view taken on the line 4–4 in FIG. 3 with the hood omitted for clarity of illustration.

A roadway milling machine 10 rotatably supports within a drum encompassing hood 12 a cylindrical tool holding drum 13. Milling bits or cutting tools 15 are replaceably mounted in tool holders 18, and these tool holders are permanently affixed to the outer periphery of the drum 13 as at 19 by welding or by any other suitable means.

As best seen in FIG. 1, the roadway milling machine 10 includes a prime mover main frame 22 supported on a pair of steering and driving wheels 24 with an engine or prime mover 25 supported in a forward engine compartment 26. A bridge 28 is pivotably secured to the rear of the main frame 22 and extends to a rear support yoke 30 which is itself supported by a pair of rear support wheels 32, only one of which is shown.

The drum encompassing hood 12 is supported by hyraulically extendible and retractable hangers 36 extending downwardly from the bridge 28 in a conventional manner as shown by Takata in U.S. Pat. No. 3,746,101.

The tool holding drum 13 includes a cylindrical shell 38 and parallel, spaced-apart end plates 39 and 40. The drum is provided with stub shafts 42 and 43 bolted to end plates 39 and 40, respectively. Stub shaft 42 has a water access opening 44 extending therethrough, and a water supply conduit 46 supplies water to the interior of the drum 13 from a bridge mounted tank 51 through an appropriate water supply gland 48 which is supported on a chain casing 50.

A pair of drum support arms 54,54 are pivotably mounted to a forward portion of the bridge 28 and rotatably supports the stub shafts 42 and 43 on bearings 55,55.

Drum 13 is driven in a first direction as indicated by the arrow on end plate 39 in FIG. 3 through the instrumentality of a driven sprocket 57 which is integrally mounted on stub shaft 42. Drum drive chain 58 is mounted on sprocket 57 and the drive sprocket 60. A pair of arms 54 are rotatably mounted on bridge 28 in axially alignment with the pivotal mounting of drum 13. This drive train consisting of drive sprocket 60, chain 58 and driven sprocket 57 is driven by the prime mover 25 in any usual or preferred manner, not shown.

When in operation, the roadway milling machine 10 moves to the left as seen in FIGS. 1 and 3 under the power of the prime mover; and the drum 13 is rotated in a first direction, clockwise as seen in FIG. 3. The cutting tools 15 literally mill out a roadway 62 including a top layer 64 of cement or asphalt, and an under layer 66 of suitable roadway base materials. In this process, without some kind of coolant supplied to the cutting tools, the extreme heat generated by the cutting tools greatly shortens the working life of those tools.

In order to effectively cool the tools, and in order to avoid having to wet down great quantities of the roadway materials being milled out, a liquid coolant such as water is supplied to the cutting tools from inside of the cylindrical drum 13 through radially extending openings in the cylindrical drum shell 38.

Figure 5:
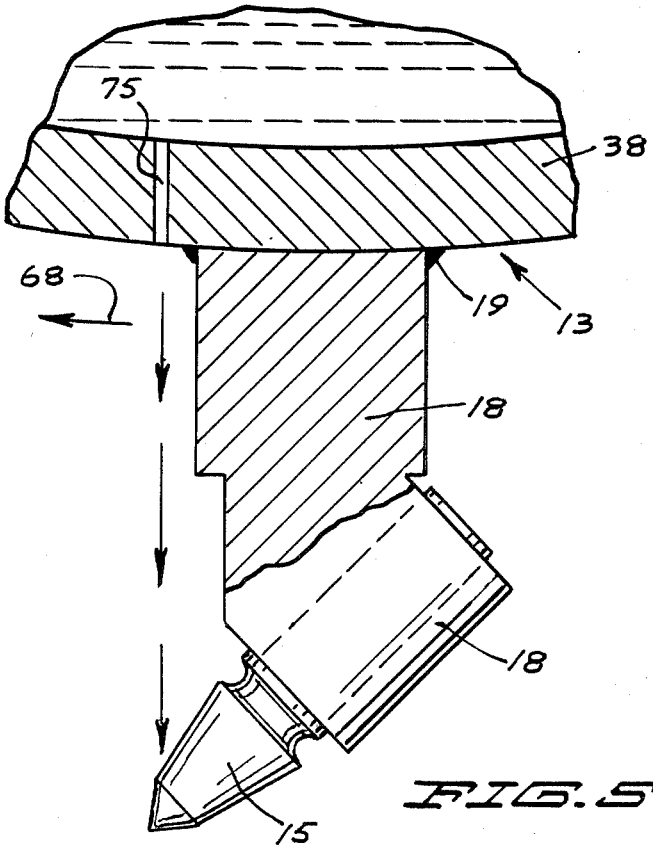
FIG. 5 is an enlarged fragmentary vertical sectional view taken on the line 5–5 in FIG. 4 and showing a structure permitting the passage of water out from inside of the drum in accordance with a first form of the invention.

To accomplish this, as seen in FIG. 5, in accordance with the first form of the invention, the cylindrical shell 38 of the tool holding drum 13 is provided with a separate coolant delivery opening 75 therethrough extending radially outwardly from the axis of the drum and located in adjacent but spaced relationship to each of the tool holders 18.

In the first form of the invention as shown, this opening 75 is located in adjacent relation to the cutting tool and tool holder at a side of the tool holder facing in the direction of the movement of the tool holder around the axis of the drum 13, as indicated by the directional arrow 68 on FIGS. 2, 3 and 5. The minimum cross-sectional area of opening 75 will be such that under normal operating speeds of rotation of the drum 13, sufficient water or other coolant will fall or be thrown through the opening that sufficient of it will flow down along or immediately adjacent tool holder 18 and will arrive at the tool 15 to tend to wet it and therefore to cool it. This will tend to bring the temperature of each cutting tool which becomes heated in the cutting process down toward a temperature equal to the boiling point of the coolant. In other words, as the machine begins to operate with the cutting tools initially at ambient temperature, the flow of water, for example, from opening 75 and down onto cutting tool 15 will hold the outer surface of the cutting tool to a temperature not above 100° C. as long as the water lies wet on the surface of the cutting tool. As more heat is generated, and the surface of the cutting tool goes above 100° C., the water will instantly flash over to steam, and the heat energy necessary to cause that to take place is, of course, heat removed from the cutting tool to tend down its temperature. It has been found that such cooling of the cutting tools very greatly prolongs the life of these cutting tools, which can, customarily, be made of steel with tungsten carbide tips.

While the first form of the invention as shown in FIG. 5 will be effective for its intended purpose, it has been considered advisable to make the walls of the cylindrical shell 38 defining each of the openings 75 cylindrical in shape and to make the minimum cross-sectional dimension of the openings slightly larger than that theoretically necessary to provide proper cooling. When the walls of these openings 75 begin to corrode, or impurities in the coolant water 52, or roadway dust and other deliterious materials entering the openings 75 there will be a reduction in the maximum cross-sectional area of the openings 75. The dimensions of openings 75 will be sufficient to allow flow of water through each of the openings to provide the necessary, desired cooling effect to the cutting tools.

When this flow is cut down sufficiently so that proper cooling is not being obtained and/or when one or more of the openings 75 becomes virtually completely clogged, the openings can be cleaned out from the outside to the inside by forcing cleaning pins of approximately the diameter of the openings 75 back through those openings, and by flushing out the deliterious materials thus accumulated on the inside of the drum by adding more coolant water into the interior of the drum 13 while it is at rest and by discharging this water and these materials through a drain opening 70 after removing drain plug 72. See FIG. 4.

Figure 6:
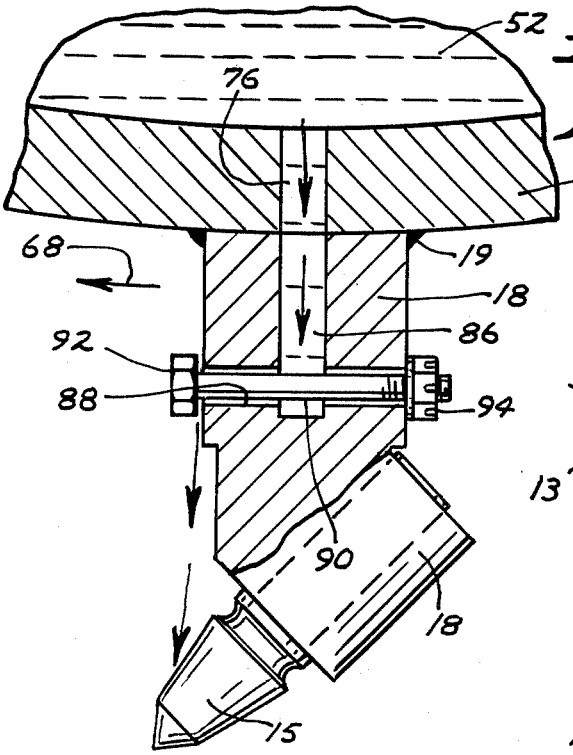
FIG. 6 is an enlarged fragmentary vertical sectional view also taken on the line 5–5 in FIG. 4 but showing a structure for permitting the passage of water from inside the drum to the cutting tool in accordance with a second form of the invention.
Figure 7:
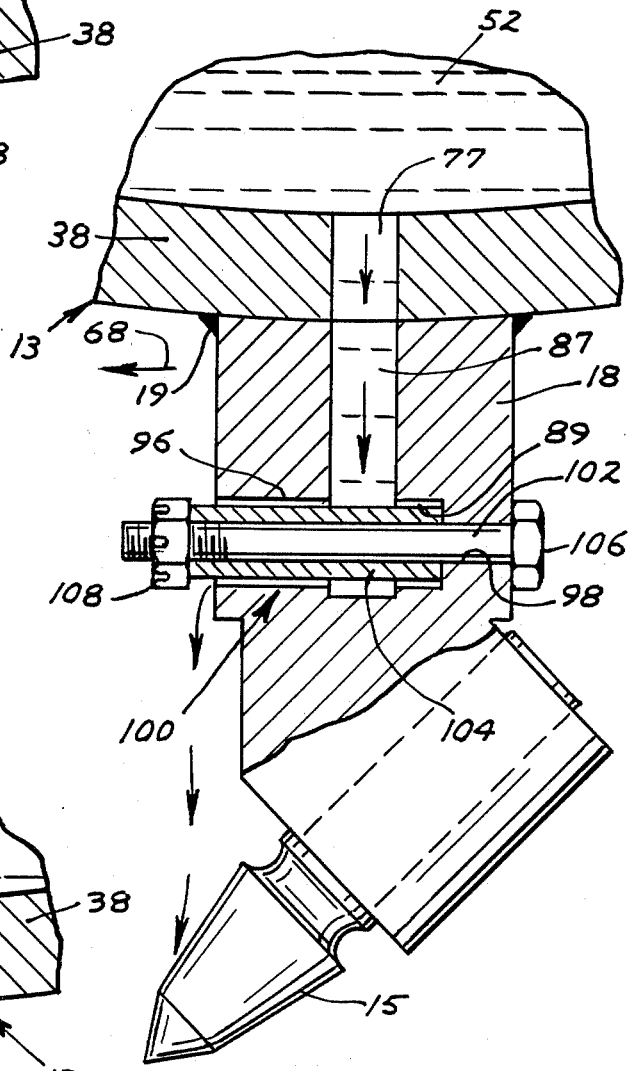
FIG. 7 is a further sectional view taken on the line 5–5 in FIG. 4, and showing a structure for permitting water to pass from the inside drum to the cutting tool in accordance with a third form of the invention.

To eliminate the potential hazard of early clogging of the flow of coolant water 52 from the drum 13 to the cutting tools 15, the structure of the second and third forms of the invention as seen in FIGS. 6 and 7, respectively, has been developed.

In a second form of the invention, as seen in FIG. 6, each tool holder 18 is provided with a radial coolant delivery slot 86. Each of these slots 86 is open at its inner end to a separate coolant delivery opening 76 through the cylindrical wall 38 of the drum 13. At its outer end, the tool holder radial slot 86 is open to a transverse coolant delivery slot 88 which extends, in the form of the invention as shown, entirely through the tool holder from a side of the tool holder facing in the direction of movement of the tool holder to a side of the tool holder adjacent the direction from which the tool holder rotates with the drum.

In order to minimize or eliminate the possibility of blocking the flow of coolant water through the delivery openings 76 in the drum shell 38 and through the radial coolant delivery slots 86 in each tool holder, the minimum cross-sectional diameter of those openings 76 and 86 is shown to be at least several times larger than the minimum cross-sectional area of slot 88 needed to limit the flow from the drum 78 to an amount needed to produce the desired cooling effect without substantial waste of coolant water. The transverse coolant delivery slot 88 of each tool holder 18 is bounded by cylindrical walls in the form of the invention as shown, and is filled with a bolt or other rod 90 which has a cross-sectional area less than that of the transverse slot 88, the difference between these cross-sectional areas being sufficient to allow enough coolant water to flow out of the transverse slot 88 in the tool holder 18 to provide the desired cooling of the cutting tools.

The bolt 90 is provided with a bolt head 92, and the bolt is retained in place, in this form of the invention as shown, by use of a castellated nut 94.

It has been found, using the structure as seen in FIG. 6, that the flow of coolant water from the transverse slots 88 will continue to adequately cool the tool holders 15 indefinitely. This is apparently due to the toroidal path of the coolant water around the outside of the bolt 90 and on the inside periphery of the slot 88 defining an opening which is not easily plugged due to the periodic shocks or vibration to which the tool holder is subjected each time the tool comes in contact with the roadway being processed. The coolant water appears to flow down (radially outwardly of the drum) the sides of each tool holder 18 and from there out along the cutting tools 15 to perform its cooling function. As clearly seen in FIG. 6, the castellated nut 94 is not tightened on the bolt 90 sufficiently to bring the bolt head 92 into sealing relationship with the first outer end of the delivery slot 88. When the bolt head 92 and the castellated nut 94 are far enough apart from each other, it is the difference in the cross-sectional diameter of the bolt 90 and of the delivery slot 88 which limits the maximum flow of coolant water outwardly from a particular tool holder 18. Should a lesser flow be needed in a particular instance, due to difference in viscosities of coolants used, or for any other reason, the flow of coolant water can be further restricted by tightening the nut 94 to bring it and the bolt head 92 closer to the tool holder at the egress of delivery slot 88 to further restrict the minimum area through which the coolant water has to pass.

Satisfactory results have been obtained by allowing cooling water to escape out of both ends of the transverse coolant delivery slot 88. Flow of water can be restricted from the transverse slot 88 by inserting an appropriate gasket or seal between the castellated nut 94 and the rear surface of the tool holder around the transverse delivery slot 88.

In order to even more positively seal the end of delivery slot 88 in the direction from which the tool holder is rotating, the third form of the invention as seen in FIG. 7 was developed.

In this form of the invention, a radial coolant delivery slot 87 of each tool holder 18 extends outwardly from a separate coolant delivery opening through the cylindrical shell 38 of the drum 13, and is open at its outer end to a transverse coolant delivery slot 89.

In this third form of the invention, a transverse coolant delivery slot 89 includes an enlarged cylindrical portion 96 open to the radial slot 87 and to a first side of the tool holder 18 in direction toward which the tool holder rotates, and a second narrower cylindrical portion 98 open to the enlarged portion 96 and through the tool holder 18 to a second opposite side thereof. A rod or rod-like assembly indicated generally at 100 includes a bolt 102 of the same diameter as that of the second portion 98 of the transverse opening 89, and a sleeve 104 having an inside diameter designed to snugly fit on the shank of the bolt 102, and having an outside diameter encompassing a total cross-sectional area less than that of the minimum cross-sectional area of the enlarged portion 96 of the transverse opening 89. The difference between the minimum cross-sectional area of the enlarged portion 96 and of the rod assembly 100 will be sufficient to allow enough coolant water to pass out through the radial opening 87 and the transverse opening 89 to the first side of the tool holder 18 so that the desired cooling effect will be added on each of the cutting tools 15 mounted in those tool holders.

As can be clearly seen from FIG. 7, bolt 102 is provided with a bolt head 106, and a castellated nut 108 is threaded down onto the sleeve 104 to seal the transverse opening 89 against any water flow to the second side of the tool holder, and to bottom the sleeve against a shoulder of the tool holder formed where the narrowed portion of the transverse slot meets with the enlarged portion thereof. The length of the sleeve 104 will be such that the castellated nut and the outer first surface of the tool holder will be so far apart as not to inhibit the flow through radial slot 87 to the tool 15. The volume of the flow of water in the form of the invention as seen in FIG. 7 will be controlled by the minimum difference in cross-sectional area of the rod assembly 100 and the enlarged portion 96 of the transverse slot 89.

What is claimed is:

1. In a roadway processing machine having a hollow, cylindrical walled, shaft mounted, imperforate drum, said drum having an internal chamber for accommodating a liquid coolant, cutting tools mounted on the drum and extending downwardly from the surface of the cylindrical wall of the drum, and support means and drive means for rotating the drum on its shaft axis in a first direction and for moving the drum over a work surface to be milled with the cutting tools in operative contact with the work surface, the improvement wherein:

means for introducing a liquid coolant into said internal chamber of the drum; said wall of the drum having a plurality of openings to allow liquid coolant to pass out of the drum, a plurality of tool holders mounted on the drum, cutting tools mounted on the tool holders, each tool holder having slot means in communication with an opening in the drum and the exterior of the tool holder whereby liquid coolant continuously flows from the interior chamber through the slot means to the outside of the tool holder and cutting tool mounted thereon to cool said cutting tool, and rod means mounted on each tool holder, said rod means being located in said slot means to limit the rate of continuous flow of liquid coolant to the outside of the tool holder and cutting tool mounted thereon.

2. The apparatus of claim 1 wherein: said rod means comprises a bolt and nut assembly loosely mounted on the tool holder to allow the bolt and nut assembly to freely move with respect to the tool holder.

3. The apparatus of claim 1 wherein:

each of said tool holder includes slot means having a radial slot extending generally radially outwardly from the drum in open, aligned relation to one of the openings through the drum wall and a transverse slot extending transversely of the radial slot, open to the radial slot and to the outside of the tool holder at least at a side facing in the direction of the movement of the tool holder with respect to the drum axis as the drum is rotated in its first direction, and said rod means having a lesser cross sectional area than that of the transverse slot, said rod means being extend through and out of the transverse slot to provide a minimum open cross sectional liquid coolant flow area large enough to permit the continuous flow of liquid coolant needed to provide cooling of the cutting tool.

4. The apparatus of claim 3 wherein:

one end of said drum shaft having an axially extending liquid coolant access opening between the end of the shaft and the interior chamber of the hollow drum; and the means for introducing a liquid coolant into said interior chamber of the drum includes a coolant tank carrying liquid coolant mounted on said support means, a liquid coolant supply gland connected to said one end of the drum shaft, and a coolant supply conduit open from said tank through the coolant supply gland to said coolant access opening in said drum shaft.

5. The apparatus of claim 1 wherein: one end of the drum shaft has an axial extended liquid coolant access opening between the end of the shaft and the interior chamber of the drum, said means for introducing liquid coolant into said interior chamber of the drum including a liquid coolant tank carrying liquid coolant mounted on said support means, a liquid coolant supply gland connected to said one end of the drum shaft, and a liquid coolant supply conduit open from said tank through the liquid coolant supply gland to said liquid coolant access opening in the drum shaft to continuously supply liquid coolant to said interior chamber of the drum during rotation thereof.

6. In a roadway processing machine having a hollow, cylindrically walled, shaft mounted, imperforate drum, said drum having an internal chamber for accommodating a liquid coolant, cutting tools mounted on the drum and extended outwardly from the surface of the cylindrical wall of the drum, and support means and drive means for rotating the drum on its shaft axis in a first direction and for moving the drum over a work surface to be milled with the cutting tools in operative contact with the work surface, of the improvements wherein: means for introducing a liquid coolant into said internal chamber of the drum; said wall of the drum having a plurality of openings to allow liquid coolant to pass out of the drum, a plurality of tool holders mounted on the drum, cutting tools mounted on the tool holders, each tool holder having slot means in communication with an opening in the drum and the exterior of the tool holder whereby liquid coolant continuously flows from the interior chamber through a slot means to the outside of the tool holder and cutting tool mounted thereon to cool said cutting tool, and rod means mounted on each tool holder, said rod means being located in said slot means to restrict the continuous flow of liquid coolant to the outside of the tool holder and tool mounted thereon, said rod means being loosely mounted in said slot means to allow the rod means to freely move with respect to the tool holder associated with each rod means.

7. In a roadway processing machine having a hollow, cylindrically walled, shaft mounted, imperforate drum, said drum having an internal chamber for accommodating a liquid coolant, cutting tools mounted on the drum and extended outwardly from the surface of the cylindrical wall of the drum, and support means and drive means for rotating the drum on its shaft axis in a first direction and for moving the drum over a work surface to be milled with the cutting tools in operative contact with the work surface, of the improvement wherein: means for introducing a liquid coolant into said internal chamber of the drum; said wall of the drum having a plurality of openings to allow liquid coolant to pass out of the drum, a plurality of tool holders mounted on the drum, cutting tools mounted on the tool holders, each tool holder having slot means in communication with an opening in the drum and the exterior of the tool holder whereby liquid coolant continuously flows from the interior chamber through a slot means to the outside of the tool holder and cutting tool mounted thereon to cool said cutting tool, and rod means mounted on each tool holder, said rod means being located in said slot means to restrict the continuous flow of liquid coolant to the outside of the tool holder and tool mounted thereon, each of said tool holders includes slot means having a radial slot extending generally radially outward from the drum in open aligned relation to one of the openings of the drum wall and a transverse slot extending transversely of the radial slot, said transverse slot open to the radial slot and to the outside of the tool holder at a side facing in the direction of the movement of the tool holder with respect to the drum axis as the drum is rotated in its first direction, said transverse slot extends entirely through said tool holder; and the rod means includes at least a bolt which extends through said transverse slot in the tool holder and is retained in that slot by a bolt head retaining member on one end and a bolt nut retaining member on the other.

8. The apparatus of claim 7 wherein:

said bolt is loosely mounted in said transverse slot to allow it to freely move with respect to the tool holder.

9. The apparatus of claim 7 wherein:

one end of said drum shaft having an axially extending liquid coolant access opening between the end of the shaft and the interior chamber of the hollow drum; and the means for introducing a liquid coolant into said interior chamber of the drum includes a liquid coolant tank carrying liquid coolant mounted on said support means, a liquid coolant supply gland connected to said one end of the drum shaft, and a liquid coolant supply conduit open from said tank through the liquid coolant supply gland to said liquid coolant access opening in said drum shaft.

10. In a machine for processing material having a hollow cylindrical walled, shaft mounted drum, said drum having an internal chamber for accommodating liquid coolant, cutting tool means mounted on the drum and extended outwardly from the surface of the cylindrical wall of the drum, support means for rotatably supporting the drum for rotation about the longitudinal axis of the drum, and drive means for rotating the drum about its axis in a first direction and for moving the drum over a work surface with the cutting tool means in operative contact with the work surface, the improvement wherein: means for introducing a liquid coolant into the interior chamber of the drum, said wall of the drum having a plurality of openings to allow the liquid coolant to flow out of the drum, said cutting tool means including a plurality of tool holders mounted on the drum, cutting tools mounted on the tool holders, each tool holder having a radial slot in alignment with one of the openings in the drum and a transverse slot open to the radial slot and to the outside of the tool holder at at least a side facing in the direction of movement of tool holder, rod means mounted on each tool holder, said rod means being located in said transverse slot to restrict the continuous flow of liquid coolant to the outside of the tool holder and cutting tool mounted thereon, said rod means includes a bolt and a sleeve on the bolt;

the transverse tool holder slot is open from the radial slot to a first end of the transverse slot at a first side of the tool holder in the direction toward which the drum rotates;

said bolt and sleeve being anchored in sealing relation to a second end of the transverse tool holder slot;

said sleeve extends outwardly of the tool holder through the first end of the transverse slot and the bolt extends outwardly of the sleeve; and a nut on an end of the bolt extending out past the first side of the tool holder is tightened against the sleeve, the length of the sleeve being such that the clearance provided between the nut and the first side of the tool holder is sufficient so as not to impede flow of coolant from the drum to the cutting tool to below the amount needed to provide the desired cooling of the cutting tool.

11. The apparatus of claim 10 wherein:

one end of said drum shaft having an axially extending liquid coolant access opening between the end of the shaft and the interior chamber of the hollow drum; and the means for introducing a liquid coolant into said interior chamber of the drum includes a liquid coolant tank carrying liquid coolant mounted on said support means, a liquid coolant supply gland connected to said one end of the drum shaft, and a liquid coolant supply conduit open from said tank through the liquid coolant supply gland to said liquid coolant access opening in said drum shaft.

12. In a roadway processing machine having a hollow cylindrically walled, shaft mounted drum, said drum having an internal chamber for accommodating a liquid coolant, cutting tool means mounted on the drum and extending outwardly from surface of the cylindrical wall of the drum, support means for rotatably supporting the drum for rotation about the longitudinal axis thereof, drive means for rotating the drum in a first direction and moving the drum over a working surface to be milled with the cutting tool means in operative contact with the working surface, the improvement wherein: means for introducing a liquid coolant into said interior chamber of the drum, said wall of the drum having means with a plurality of openings to allow liquid coolant to continuously flow out of the drum through said openings and impinge upon and cool the cutting tool means, one end of said drum shaft having an axially extending liquid coolant access opening between the end of the shaft and the interior chamber of the hollow drum; and the means for introducing liquid coolant into said interior chamber of the drum includes a coolant tank carrying liquid coolant mounted on said support means, a liquid coolant supply gland connected to said one end of the drum shaft, and a coolant supply conduit open from said tank through the liquid coolant supply gland to said liquid coolant access opening in said drum shaft.

13. The apparatus of claim 2 wherein: said means with a plurality of openings includes a plurality of tool holders mounted on the drum, cutting tools mounted on the tool holders, each tool holder having slot means in communication with an opening in the drum and the exterior of the tool holder whereby liquid coolant continuously flows from the interior chamber through the slot means to the outside of the tool holder and cutting tool mounted thereon to cool said cutting tool.

14. A machine for milling natural and man laid material comprising:

a frame;

rotatable means for milling the material;

means rotatably mounting the rotatable means on the frame, power means for rotating the rotatable means, said rotatable means including a rotatable support, material cutting tools, and tool holder means for mounting the tools on the support, and means for continuously supplying a liquid coolant to said cutting tools during the rotation thereof, each of said tool holder means having a passage for accommodating liquid coolant and an outlet opening open to said passage for directing the liquid coolant toward the cutting tool, and rod means mounted on the tool holder means located in said outlet opening for controlling the continuous flow of liquid coolant to said cutting tool, said rod means being smaller in diameter than said outlet opening to limit the rate of continuous flow of liquid coolant through said outlet opening to said cutting tool.

15. The machine of claim 14 including: means loosely mounting the rod means on the tool holder means to allow the rod means to freely move with respect to the tool holder means.

16. The machine of claim 14 wherein: said outlet opening has an end located in the direction of movement of the tool holder means.

17. A machine for milling natural and man made material comprising: a frame; rotatable means for milling the material; means for rotatably mounting the rotatable means on the frame, power means for rotating the rotatable means, said rotatable means including rotatable support means, material cutting tools, and tool holder means for mounting the tools on the support means, and means for continuously supplying liquid coolant to said cutting tools during the rotation thereof, each of said tool holder means having a passage for accommodating liquid coolant and an outlet opening open to the passage for directing the liquid coolant toward the cutting tool mounted thereon, and rod means mounted on the tool holder means located in said outlet opening for controlling the continuous flow of liquid coolant to said cutting tool, said rod means being smaller in diameter than said outlet opening to limit the rate of continuous flow of liquid coolant through said outlet opening to said cutting tool, said outlet opening having an end located in the direction of movement of the tool holder means, said rod means mounted on the tool holder means having releasable means for adjusting the rate of flow of liquid coolant out of the end of the outlet opening.

18. The machine of claim 17 wherein: the releasable means includes a nut and bolt assembly extended through the outlet opening and mounted on the tool holder means.

19. A machine for milling natural and man laid material comprising:

a frame;

rotatable means for milling the material;

means rotatably mounting the rotatable means on the frame, power means for rotating the rotatable means, said rotatable means including a rotatable support, material cutting tools, tool holder means for mounting the cutting tools on the support, and means for supplying a liquid coolant to said cutting tools during the rotation thereof, each of said tool holder means having a passage for accommodating liquid coolant and an outlet opening open to said passage for directing the liquid coolant toward the cutting tool, and means mounted on the tool holder means located in said outlet openings for controlling the flow of liquid coolant to said cutting tool, said means mounted on the tool holder means including a bolt and a sleeve on the bolt, said sleeve extended outward of the tool holder means through the outlet opening, and means securing the bolt to the tool holder means.

20. The machine of claim 19 wherein: said outlet opening extends in the direction of movement of the tool holder means, said sleeve extended through said outlet opening.

21. The machine of claim 19 wherein: the rotatable support includes a drum having an internal chamber for accommodating liquid coolant, said tool holder means being mounted on said drum, said passage of the tool holder means being open to the internal chamber whereby liquid coolant flows from the chamber through the passage and outlet opening upon rotation of the drum.

22. In a roadway processing machine having a hollow walled, shaft mounted drum, said drum having an internal chamber for accommodating a liquid coolant, cutting tool means mounted on the drum and extended outwardly from a surface of a cylindrical wall of the drum, support means for rotatably supporting the drum for rotation about the longitudinal axis thereof, drive means for rotating a drum in a first direction and moving the drum over a working surface to be milled with the cutting tool means in operative contact with the working surface, the improvement comprising: means for introducing a liquid coolant into said interior chamber of the drum, said wall of the drum having means with a plurality of openings to allow liquid coolant to continuously flow out of the drum through said openings and impinge upon and cool the cutting tool means, one end of the drum shaft having an axially extended liquid coolant axis opening between the end of the shaft and the interior of the chamber of the hollow drum, and means for introducing liquid coolant into said interior chamber of the drum including a coolant tank carrying liquid coolant mounted on said support means, a liquid coolant supply gland connected to said one end of said drum shaft, and a liquid coolant supply conduit open from the tank to the liquid coolant supply gland to supply said liquid coolant to the axis opening in said drum shaft, said means with a plurality of openings including a plurality of tool holders mounted on the drum, cutting tools mounted on the tool holders, each tool holder having slot means in communication with the opening in the drum and the exterior of the tool holder whereby liquid coolant continuously flows from the interior chamber through the slot means to the outside of the tool holder and cutting tool mounted thereon to cool said cutting tool, and rod means mounted on each tool holder, said rod means being located in said slot means to limit the rate of continuous flow of liquid coolant to the outside of the tool holder and cutting tool mounted thereon, said rod means comprising a bolt and nut assembly loosely mounted on the tool holder to allow the bolt and nut assembly to freely move with respect to the tool holder.

23. In a roadway processing machine having a hollow walled, shaft mounted drum, said drum having an internal chamber for accommodating a liquid coolant, cutting tool means mounted on the drum and extended outwardly from a surface of a cylindrical wall of the drum, support means for rotatably supporting the drum for rotation about the longitudinal axis thereof, driven means for rotating a drum in a first direction and moving the drum over a working surface to be milled with the cutting tool means in operative contact with the working surface, the improvement comprising: means for introducing a liquid coolant into said interior chamber of the drum, said wall of the drum having means with a plurality of openings to allow liquid coolant to continuously flow out of the drum through said openings and impinge upon and cool the cutting tool means, one end of the drum shaft having an axially extended liquid coolant axis opening between the end of the shaft and the interior of the chamber of the hollow drum, and means for introducing liquid coolant into said interior chamber of the drum including a coolant tank carrying liquid coolant mounted on said support means, a liquid coolant supply gland connected to said one end of said drum shaft, and a liquid coolant supply conduit open from the tank to the liquid coolant supply gland to supply said liquid coolant to the axis opening in said drum shaft, said means with a plurality of openings including a plurality of tool holders mounted on the drum, cutting tools mounted on the tool holders, each tool holder having slot means in communication with the opening in the drum and the exterior of the tool holder whereby liquid coolant continuously flows from the interior chamber through the slot means to the outside of the tool holder and cutting tool mounted thereon to cool said cutting tool, and rod means mounted on each tool holder, said rod means being located in said slot means to limit the rate of continuous flow of liquid coolant to the outside of the tool holder and cutting tool mounted thereon, said slot means having a radial slot extended generally radial outwardly from the drum in open aligned relation with one of the openings through the drum wall and a transverse slot extending transversely of the radial slot, said transverse slot being open to the radial slot and to the outside of the tool holder at least at a side facing in the direction of movement of the tool holder during rotation of the drum, said rod means having a lesser cross sectional area than that of the transverse slot, said rod means extended through and out of the transverse slot to provide a continuously open cross sectional liquid coolant flow area to allow the continuous flow of liquid coolant to cool the cutting tool.

24. The apparatus of claim 23 wherein: the rod means is loosely mounted in said transverse slot to allow the rod means to freely move in respect to the tool holder associated with each rod means.

25. A method of milling natural and man laid material with cutting tools mounted on rotatable means with tool holders having liquid coolant discharge openings comprising: rotating the rotatable means to move the cutting tools into engagement with the material whereby the cutting tools cut said material, continuously supplying liquid coolant to said tool holders during rotation of the rotatable means, continuously discharging liquid coolant from the tool holders toward the cutting tools during rotation of the rotatable means whereby said liquid coolant continuously cools said tool holders and cutting tools during the cutting of said materials with the cutting tools, and limiting the continuous discharge of liquid coolant from the liquid coolant discharge openings with rod means located therein to prevent excess discharge of liquid coolant from the tool holders.

26. The method of claim 25 including: continuously discharging liquid coolant from the tool holders in the direction of movement of the tool holders.

27. The method of claim 25 including: allowing the rod means to have limited free movement along the length thereof relative to the tool holders during the discharge of liquid coolant from the discharge opening.

28. The method of claim 25 wherein: the rotatable means is a drum having an interior chamber for accommodating liquid coolant, said tool holders being mounted on the drum and having slot means open to the interior chamber and exterior of the tool holders the improvement of: supplying liquid coolant to the interior chamber of the drum, continuously supplying liquid coolant from said chamber to said slot means during rotation of the drum, continuously discharging liquid coolant from the slot means toward the cutting tools to continuously cool said cutting tools, and limiting the continous discharge of liquid coolant from the slot means with rod means located in the slot means.

29. The method of claim 28 including: continuously discharging liquid coolant from the tool holders in the direction of movement of the tool holders.

30. The method of claim 28 including: allowing the rod means to have limited free movement along the length thereof relative to the tool holder during the discharge of liquid coolant from the slot means.

31. A machine for milling natural and man laid material comprising: a frame; rotatable means for milling the material; means rotatably mounting the rotatable means on the frame, power means for rotating the rotatable means, said rotatable means including a rotatable support, material cutting tools, and tool holder means for mounting the tools on the support, and means for continuously supplying a liquid coolant to said cutting tools during the rotation thereof, each of said tool holder means having a passage for accommodating liquid coolant and an outlet opening open to said passage for controlling the rate of continuous flow of liquid coolant toward the cutting tool.

* * * * *